US009609440B2

(12) United States Patent
Busca Grisoni et al.

(10) Patent No.: US 9,609,440 B2
(45) Date of Patent: Mar. 28, 2017

(54) TEMPLATE FOR IMPLANTING A HOUSING OF A HEARING INSTRUMENT

(75) Inventors: Louisa Busca Grisoni, Bonvillars (CH); Christian Imbert, Froideville (CH)

(73) Assignee: Advanced Bionics AG, Staefa (CH)

( * ) Notice: Subject to any disclaimer, the term of this patent is extended or adjusted under 35 U.S.C. 154(b) by 256 days.

(21) Appl. No.: 14/122,243

(22) PCT Filed: May 30, 2011

(86) PCT No.: PCT/EP2011/058828

§ 371 (c)(1),
(2), (4) Date: Nov. 25, 2013

(87) PCT Pub. No.: WO2012/163397

PCT Pub. Date: Dec. 6, 2012

(65) Prior Publication Data

US 2014/0107400 A1 Apr. 17, 2014

(51) Int. Cl.
*H04R 25/00* (2006.01)

(52) U.S. Cl.
CPC ..... *H04R 25/00* (2013.01); *H04R 25/606* (2013.01); *H04R 25/65* (2013.01); *H04R 2225/67* (2013.01)

(58) Field of Classification Search
CPC ..... H04R 25/606; H04R 25/65; H04R 25/00; H04R 2225/67

(Continued)

(56) References Cited

U.S. PATENT DOCUMENTS 4,774,933 A * 10/1988 Hough ..... A61B 17/862 381/326
5,906,635 A * 5/1999 Maniglia ..... A61N 1/36032 607/57

(Continued)

FOREIGN PATENT DOCUMENTS

DE 20012506 8/2001
WO WO-9732629 9/1997

(Continued)

OTHER PUBLICATIONS

International Search Report and Written Opinion received in International Application No. PCT/EP2011/058828 dated Nov. 15, 2012.

*Primary Examiner* — Navin Natnithithadha
*Assistant Examiner* — Sunita Reddy
(74) *Attorney, Agent, or Firm* — ALG Intellectual Property, LLC

(57) ABSTRACT

The invention relates to a template for implanting a housing of an implantable unit of a partially implantable hearing instrument, comprising a template plate comprising an implant position marking opening and a template position indicating element which extends substantially normal with regard to the surface of the template plate, wherein the implant position marking opening is designed to mark the position of a receptacle to be created in the patient's temporal bone for receiving an elevated housing positioning portion of the housing, and wherein the template position indicating element is a projection designed to be seen or felt by a surgeon through the patient's skin when the template plate is positioned at the patient's skull to mark the position of said receptacle.

23 Claims, 4 Drawing Sheets

(58) Field of Classification Search
USPC ..... 600/25; 128/897–899; 623/19; 381/322; 607/57
See application file for complete search history.

(56) References Cited

U.S. PATENT DOCUMENTS

| | | | | |
|---|---|---|---|---|
| 6,097,826 | A * | 8/2000 | Clavadetscher | H04R 25/658 381/322 |
| 6,306,168 | B1 * | 10/2001 | Berrang | A61N 1/0541 607/137 |
| 7,974,700 | B1 * | 7/2011 | Gibson | A61N 1/36046 607/116 |
| 2001/0008560 | A1 * | 7/2001 | Stonikas | H04R 25/652 381/322 |
| 2003/0199886 | A1 * | 10/2003 | Thomas | A61B 90/11 606/130 |
| 2004/0243177 | A1 | 12/2004 | Svehla et al. | |
| 2008/0234793 | A1 | 9/2008 | Gibson | |
| 2009/0177220 | A1 | 7/2009 | Zimmerling et al. | |
| 2009/0312769 | A1 | 12/2009 | Dadd et al. | |
| 2010/0017006 | A1 * | 1/2010 | Clausen | H04R 1/1016 700/98 |
| 2010/0145135 | A1 * | 6/2010 | Ball | H04R 25/606 600/25 |
| 2010/0174292 | A1 | 7/2010 | Labadie et al. | |
| 2011/0264170 | A1 * | 10/2011 | Gibson | A61N 1/36032 607/57 |

FOREIGN PATENT DOCUMENTS

| | | |
|---|---|---|
| WO | WO-2009/048999 | 4/2009 |
| WO | WO-2010/151765 | 12/2010 |
| WO | WO-2011/036310 | 3/2011 |

* cited by examiner

TEMPLATE FOR IMPLANTING A HOUSING OF A HEARING INSTRUMENT

The invention relates to a template for implanting a housing of an implantable unit of a partially implantable hearing instrument.

Surgical templates and tools are used by surgeons to help them to achieve optimal manipulation and placement of the devices to be implanted.

Partially implantable hearing instruments typically comprise an implantable actuator, for example an electromechanical actuator coupled to an ossicle or directly to the cochlea or a cochlear implant electrode, an implantable unit having a housing which contains a driver for the actuator, a rechargeable battery, an electronics unit and at least one coil for receiving data and power via a wireless transcutaneous link, and an external unit which is to be fixed at the patient's head in a releasable manner, typically via magnetic forces, at a position close to the implantable unit and which includes a microphone arrangement, an audio signal processing unit, a battery, and at least one coil for inductive coupling with the coil of the implantable unit in order to transmit audio signals and data via the wireless transcutaneous link to the implantable unit. An example of such partially implantable hearing instrument is described in WO 2011/036310 A2.

The housing of the implantable unit typically is implanted within an artificial recess created within the temporal bone ("bone bed"), and the actuator is positioned via a fixation system which is screwed to the temporal bone. During operation of the hearing instrument, the coil of the external unit should be aligned with regard to the coil of the implantable unit. Therefore, the position and orientation of the implantable unit should be precisely correlated to the desired position of the external unit at the patient's head. In particular, the recess in the temporal bone for receiving the implantable unit should be created at an appropriate position.

WO 2009/048999 A1 relates to a magnet positioning tool for a cochlea implant system for inserting and removing a magnet of an implantable part of the cochlea implant system.

US 2010/0174292 A1 relates to a surgical tool for placing a stapes prosthesis within a patient's middle ear.

US 2009/0312769 A1, US 2004/0243177 A1, US 2008/0234793 A1 and WO 2010/151765 A1 relate to surgical tools for implanting cochlea electrodes into a patient's cochlea.

It is an object of the invention to provide for a template which allows implantation of the housing of an implantable unit of a partially implantable hearing instrument in such a manner that the position and orientation of the implantable unit enables optimal interaction of the implantable unit and the external unit.

According to the invention, the above object is achieved by a template as defined in claim 1.

The invention is beneficial in that, by providing the template with an implant position marking opening and a template position indicating element which extends substantially normal with regard to the surface of the template plate and which is designed to be seen or felt by the surgeon through the patient's skin when the template plate is positioned at the patient's skull to mark, via the implant position marking opening, the position of a receptacle to be created in the patient's temporal bone for receiving an elevated housing positioning portion of the housing of the implantable unit, the implantable unit can be precisely and conveniently positioned in such a manner that the implant position is well correlated to the position of an external reference mark. In particular, thereby the position of the implantable unit may be precisely correlated with the position at which an external unit of the hearing instrument is to be best positioned at the patient's head. Thus, for example, the coils of the external unit and the implantable unit may be aligned.

Preferred embodiments of the invention are defined in the dependent claims.

Hereinafter, examples of the invention will be illustrated by reference to the attached drawings, wherein.

Figure 1:
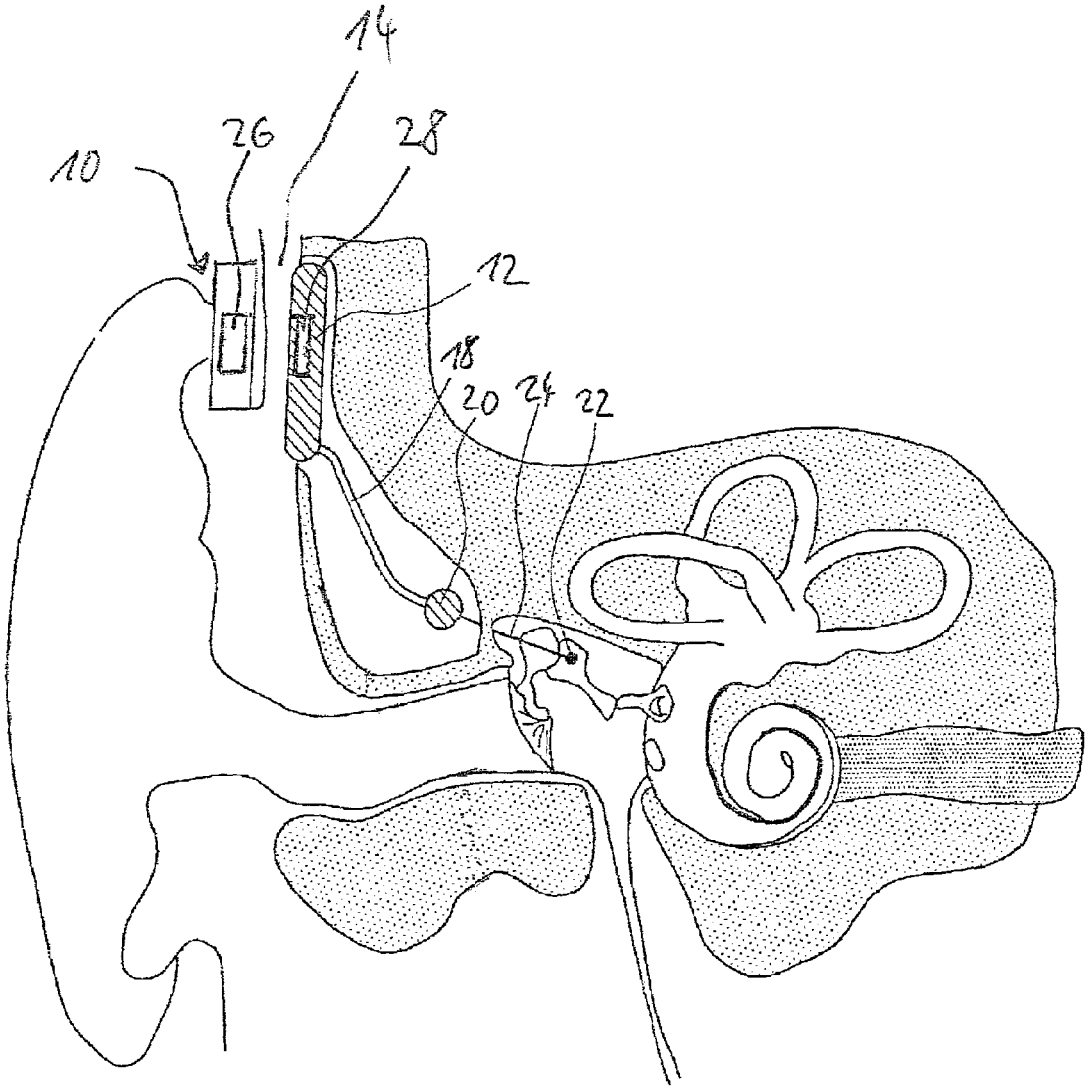
FIG. 1 is a schematic cross-sectional view of an implantable hearing instrument after implantation.

FIG. 1 shows a cross-sectional view of the mastoid region, the middle ear and the inner ear of a patient after implantation of an actuator of an example of a hearing aid according to the invention, wherein the hearing aid is shown only schematically. The system comprises an external unit 10, which is worn outside the patient's body at the patient's head, and an implantable unit 12, which is implanted under the patient's skin 14, usually in an artificial bed created in the user's mastoid. The implantable unit 12 is connected via a cable assembly 18 to an actuator 20. While in FIG. 1 an electromechanical actuator coupled to an ossicle 22 via a coupling rod 24 is shown, the actuator 20 also may be an electromechanical actuator coupled directly to the cochlear wall, e.g. an artificial incus may be coupled to a stapes prosthesis moving through the oval window.

The external unit 10 is fixed at the patient's skin 14 in a position opposite to the implantable unit 12, for example, by magnetic forces created between a magnetic fixation arrangement 26 provided in the external unit 10 and a cooperating magnetic fixation arrangement 28 provided in the implantable unit 12, respectively.

Figure 2:
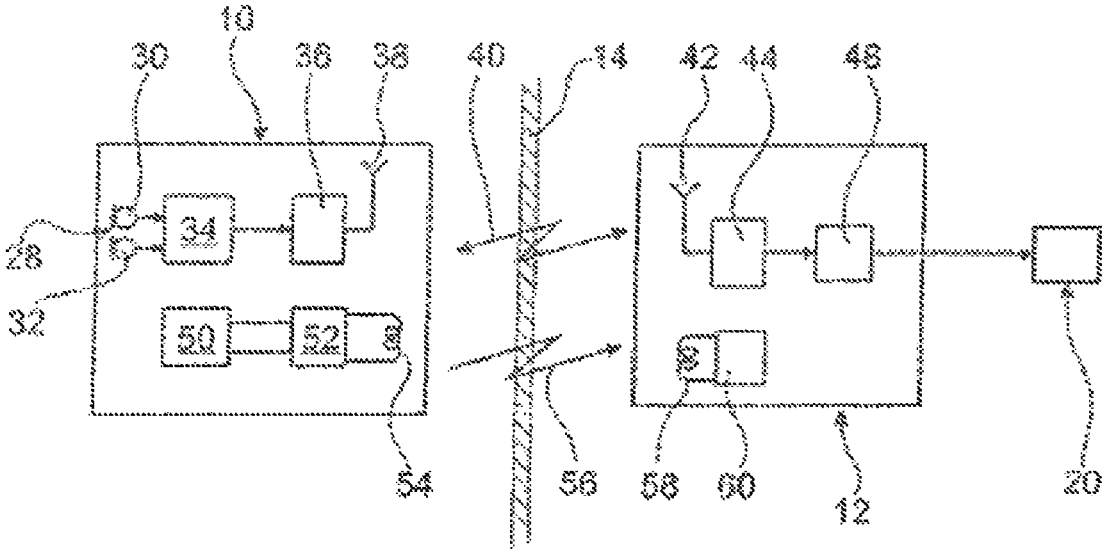
FIG. 2 is a block diagram of the system of FIG. 2.

An example of a block diagram of the system of FIG. 1 is shown in FIG. 2. The external unit 10 includes a microphone arrangement 28, which typically comprises at least two spaced-apart microphones 30 and 32 for capturing audio signals from ambient sound, which audio signals are supplied to an audio signal processing unit 34, wherein they undergo, for example, acoustic beam forming. The processed audio signals are supplied to a transmission unit 36 connected to a transmission antenna 38 in order to enable transcutaneous transmission of the processed audio signals via an inductive link 40 to the implantable unit 12 which comprises a receiver antenna 42 connected to a receiver unit 44 for receiving the transmitted audio signals. The received audio signals are supplied to a driver unit 48 which drives the actuator 20.

The external unit 10 also comprises a power supply 50 which may be a replaceable or rechargeable battery, a power transmission unit 52 and a power transmission antenna 54 for transmitting power to the implantable unit 12 via a wireless power link 56. The implantable unit 12 comprises a power receiving antenna 58 and a power receiving unit 60 for powering the implanted electronic components with power received via the power link 56.

The audio signal antennas 38, 42 may be separated from the power antennas 54, 58 in order to optimize both the audio signal link 40 and the power link 56. However, if a particularly simple design is desired, the antennas 38 and 54 and the antennas 42 and 58 may be physically formed by a single antenna, respectively.

Figure 3:
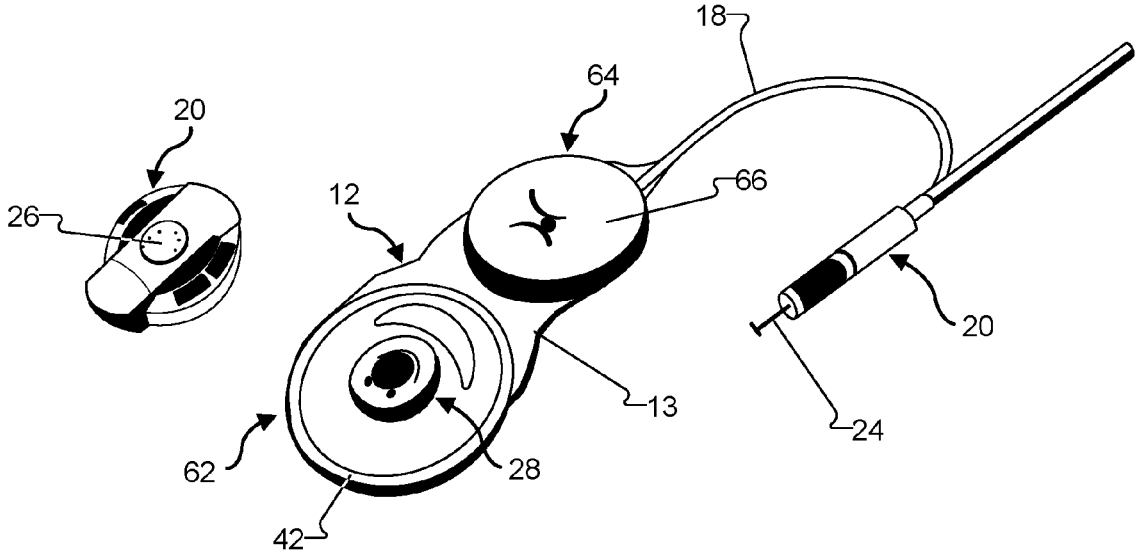
FIG. 3 is a perspective view of the components of an example of a partially implantable hearing instrument.
Figure 4A:
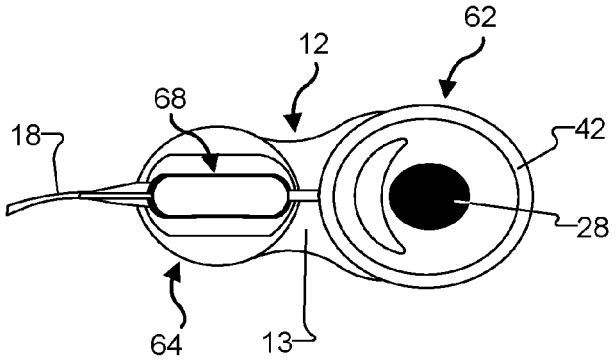
FIGS. 4A and 4B are an elevated view and a side view, respectively, of the implantable unit of the implant assembly of the hearing instrument of FIG. 3.

In FIGS. 3 and 4 an example of the geometric design of a hearing instrument of the type shown in FIGS. 1 and 2 is shown, wherein the external unit 10 has a substantially circular, disc-like shape, with the magnet 26 being located in the center thereof. The implantable unit 12 has a housing 13 having a substantially plate-like design with a first portion 62 containing the coil 42 and the magnet 28 in the center of the coil 42 (in the example shown in FIGS. 3 and 4 the coil 42 serves both for data and power reception and hence combines the functionality of the coils 42 and 58 of FIG. 2; accordingly, the external unit 10 comprises a single transmission coil 38 combining the functionality of the coils 38 and 54 of FIG. 2). The housing 13 of the implantable unit 12 also comprises a second portion 64 containing an electronics module 66.

Figure 4B:
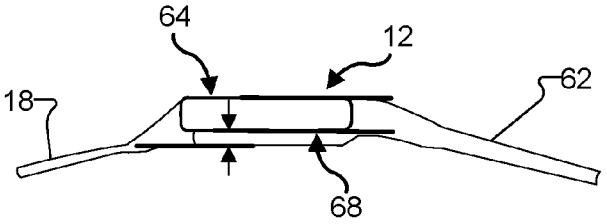

At the side facing the patient's temporal bone the second portion 64 is provided with an elevated housing portion 68 which is a projecting flat structure extending above the level of the adjacent flat surface of the housing of the implantable unit 12, preferably by from 1 to 5 mm. The housing positioning portion 68 serves to fit into a well milled into the patient's temporal bone in order to hold the implantable unit 12 at the desired position after implantation. As can be seen in FIG. 4B, the first portion 62 of the implantable unit 12 is slightly angled with regard to the second portion 64.

In order to achieve optimal performance of the hearing instrument, it is important that after implantation of the implantable unit 12 and the actuator 20 the external unit 10 is positioned with regard to the implantable unit 12 in such a manner that the coil 38 of the external unit 10 and the coil 42 of the implantable unit 12 are aligned with regard to each other so that maximal inductive coupling is achieved for audio signal and power transmission. In order to achieve such alignment it is important that the implantation position of the implantable unit 12 is precisely correlated to the desired wearing position of the external unit 10 at the patient's head.

Figure 5:
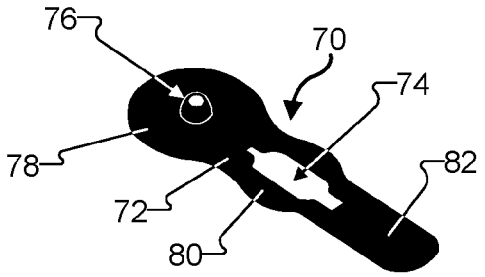
FIG. 5 is a perspective view of an example of a template according to the present invention.

In order to enable such correlated implantation of the implantable unit 12 the template shown in FIG. 5 may be used.

According to FIG. 5, the template 70 comprises a template plate 72 comprising an implant position marking opening 74 and a template position indicating element 76 which extends substantially normal with regard to the surface of the template plate 72. Preferably, the element 76 is located in the center of a first end portion 78 of the template 70, which end portion 78 may have an at least partially circular or oval contour or any other shape. The opening 74 preferably is located in a central portion 80 of the template 70. The second end portion 82 of the template 70 opposite to the first end portion 78 may have an elongate shape with a rounded end.

The element 76 is a projection which may have a bump-like shape with a rounded or chamfered top portion. The element 76 may have a rotational symmetry with regard to an axis extending normal to the surface of the template plate 72. The bottom of the element 76 may have a diameter from 3 to 20 mm, and the top of the element 76 may extend from 1 to 10 mm above the surface level of the template plate 72. While in the example only one template position indicating element 76 is shown, the template 70 may comprises a plurality of such elements 76.

Preferably, the template 70 is made of bio compatible material (Titanium, Stainless Steel, Bio plastic etc. . . . ). Preferably, the template 70 is made of a single piece.

The opening 74 is designed to mark the position of a well or receptacle to be milled into the patient's temporal bone for receiving the housing positioning portion 68 of the implantable unit 12. Preferably, the shape of the opening 74 corresponds to the shape of the housing positioning portion 68 of the implantable unit 12. In particular, the opening 74 may serve as a template for a cutting or drilling tool used for milling such receptacle into the patient's temporal bone.

Hereinafter, an example will be given of how the hearing instrument of FIGS. 3 and 4 may be implanted using the template 70.

Figure 6:
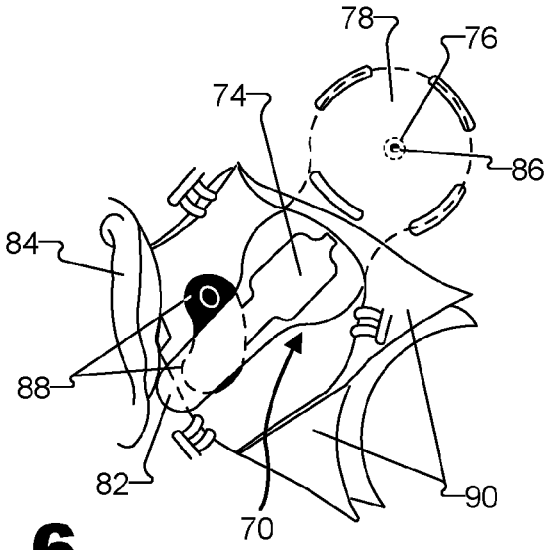
FIG. 6 is a schematic view of a part of a patient's head where an implant assembly of an implantable hearing instrument is to be implanted, wherein the template is positioned for marking the position of a receptacle for part of the housing of the implantable unit of the implant assembly.

After the region behind the patient's ear 84 has been prepared for surgery, the desired final position of the external unit 10 is marked on the patient's skin with surgical ink using an appropriate positioning template, thereby generating an ink mark 86 on the patient's skin. The position is selected to achieve good sound reception by the microphones 30, 32. A retroauricular skin incision is then made in order to expose the periosteum. An anteriorly-based periosteal flap is then elevated to expose the Henle's spine which serves as a reference mark to place a mastoidectomy template (not shown). As a next step, a mastoidectomy is performed by using an appropriate drilling tool. The mastoidectomy cavity is indicated at 88 in FIG. 6, and the elevated skin flaps are indicated at 90.

Figure 7:
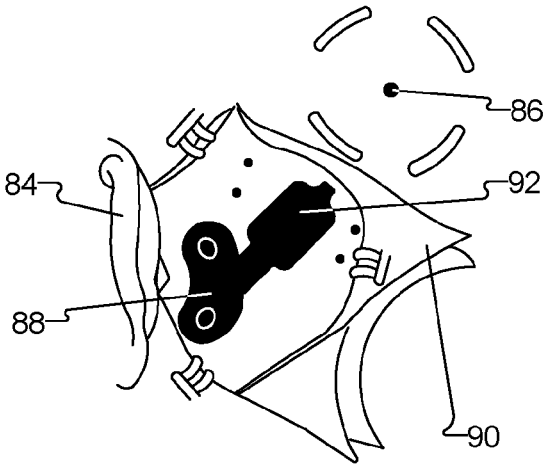
FIG. 7 is a view like FIG. 6, wherein the template has been removed.

As a next step, a receptacle or well ("bone bed") is to be prepared on the temporal bone for implanting the implantable assembly 12, in particular for receiving the housing positioning portion 68 thereof. In order to precisely determine the location of such receptacle, the first end 78 of the template 70 is inserted between the skin and the temporal bone in such a manner that the position of the template position indicating element 76 coincides with the position of the ink mark 86 on the skin. To this end, the element 76 is designed such that its contour can be seen or felt by the surgeon through the patient's skin. The implant position marking opening 74 then is used for marking the position where the receptacle (which is indicated at 92 in FIG. 7) is to be milled into the temporal bone. The receptacle 92 then may be created with the help of cutting burrs, with the opening 74 being used as a template for guiding the cutting tool. FIG. 7 shows the result of such drilling process.

Subsequently, the actuator fixation system 94 is fixed at the temporal bone and the actuator 20 is positioned in the mastoidectomy cavity 88, with a stapedotomy opening being prepared for coupling an artificial incus carried by the tip of the coupling rod 24 of the actuator 20 to the cochlea.

Figure 8:
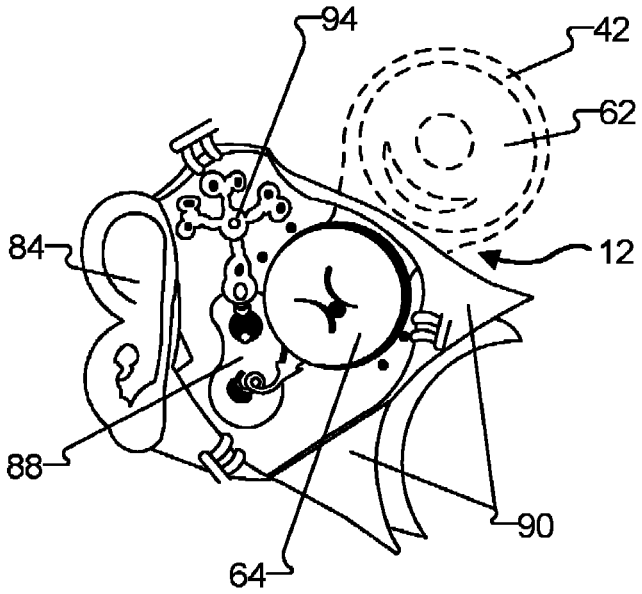
FIG. 8 is a view like FIG. 7, wherein the implant assembly is shown in the final implanted position.

The implantable unit 12 is installed by placing the first portion 62 of the housing 13 of the implantable unit 12 under the skin so that its final position matches with the desired final position of the external unit 10. This is achieved by placing the housing positioning portion 68 within the receptacle 92. The final position of the implant assembly consisting of the implantable unit 12 and the actuator 20 prior to closing of the incision is shown in FIG. 8.

The template 70 is designed such that the distance and the orientation of the template position indicating element 76 and the implant position marking opening 74 relative to each other is selected according to the desired final positions of the external unit 10 and the implantable unit 12 relative to each other. In particular, the distance and orientation of the element 76 and the opening 74 relative to each other is preferably selected to align the coils 38 and 42 of the external unit 10 and the implantable unit 12.

The invention claimed is:

1. A template for implanting a housing of an implantable unit of a partially implantable hearing instrument underneath a skin of a patient, comprising:

a template plate comprising a planar surface that has a first end portion, a central portion, and a second end portion all surrounded by an outer edge of the template plate;

an implant position marking opening within the central portion of the planar surface of the template plate; and a template position indicating element which extends from a location that is within the first end portion of the planar surface of the template plate and that is horizontally offset away from the outer edge of the template plate in a same plane of the planar surface, the template position indicating element extending away vertically from the planar surface of the template plate along an axis that is normal to the planar surface of the template plate, wherein the implant position marking opening is configured to mark a position of a receptacle to be created in a temporal bone of the patient for receiving an elevated housing portion of the housing, and wherein the template position indicating element is a projection configured to indicate a position of the template after the template has been inserted underneath the skin of the patient.

2. The template of claim 1, wherein the template position indicating element has a bump shape.

3. The template of claim 2, wherein the template position indicating element has a rotational symmetry with regard to the axis normal to the planar surface of the template plate.

4. The template of claim 3, wherein the template position indicating element has a diameter of from 3 to 20 mm at a bottom of the template position indicating element.

5. The template of claim 1, wherein a top of the template position indicating element extends from 1 to 10 mm above the planar surface of the template plate.

6. The template of claim 1, wherein the template is designed such that the template position indicating element is to be aligned with a mark on the skin of the patient indicating a position of an external unit of the hearing instrument.

7. The template of claim 1, wherein the template is made of a bio compatible material.

8. The template of claim 1, wherein the template is made of a single piece.

9. The template of claim 1, wherein the location from which the template position indicating element extends is in a center of the first end portion of planar surface of the template plate, wherein the first end portion has at least a partially circular or oval contour.

10. The template of claim 1, wherein the implant position marking opening is located in a center of the central portion of the template plate.

11. The template of claim 1, wherein the template position indicating element is laterally offset in its entirety from the implant position marking opening.

12. A system comprising:

a template comprising:

a template plate that has a planar surface having a first end portion, a central portion, and a second end portion all surrounded by an outer edge of the template plate, an implant position marking opening within the central portion of the planar surface of the template plate, and a template position indicating element which extends from a location that is within the first end portion of the planar surface of the template plate and that is horizontally offset away from the outer edge of the template plate in a same plane of the planar surface, the template position indicating element extending away vertically from the planar surface of the template plate along an axis that is normal to the planar surface of the template plate; and a partially implantable hearing instrument, said partially implantable hearing instrument comprising an implantable unit and an external unit to be releasably fixed at a head of a patient, wherein the template is designed such that a distance and an orientation of the template position indicating element and the implant position marking opening relative to each other are selected according to desired final positions of the external unit and the implantable unit relative to each other, wherein the implant position marking opening is configured to mark a position of a receptacle to be created in a temporal bone of the patient for receiving an elevated housing portion of the implantable unit, and wherein the template position indicating element is a projection configured to indicate a position of the template after the template has been inserted underneath the skin of the patient.

13. The system of claim 12, wherein the implantable unit and the external unit comprise means for transmitting audio signals and control signals from the external unit to the implantable unit via a wireless transcutaneous link.

14. The system of claim 12, wherein the implantable unit and the external unit comprise means for wirelessly transmitting power from the external unit to the implantable unit via a wireless transcutaneous link.

15. The system of claim 14, wherein the implantable unit and the external unit each comprise at least one coil for establishing said wireless transcutaneous link as an inductive link.

16. The system of claim 15, wherein the template is designed such that a distance and an orientation of the template position indicating element and the implant position marking opening relative to each other is selected to align the coil of the implantable unit and the external unit.

17. The system of claim 12, wherein a shape of the implant position marking opening of the template corresponds to a shape of the elevated housing portion of the implantable unit.

18. The system of claim 17, wherein the elevated housing portion of the implantable unit is a projecting flat structure which extends from 1 to 5 mm above a level of flat surface of the implantable unit.

19. The system of claim 12, wherein a housing of the implantable unit has a plate design.

20. The system of claim 12, wherein the external unit has a circular, disc shape.

21. A method of implanting a partially implantable hearing instrument comprising an implantable unit and an external unit to be releasably fixed at a head of a patient, the method comprising:

providing a template that includes a template plate comprising a planar surface that has a first end portion, a central portion, and a second end portion all surrounded by an outer edge of the template plate, an implant position marking opening within the central portion of the planar surface of the template plate, and a template position indicating element which extends from a location that is within the first end portion of the planar surface of the template plate and that is horizontally offset away from the outer edge of the template plate in a same plane of the planar surface, the template position indicating element extending away vertically from the planar surface of the template plate along an axis that is normal to the planar surface of the template plate;

marking a desired final position of the external unit by applying an external unit position mark on the skin of the patient;

providing a cut in the skin of the patient;

inserting the template into the cut in such a manner that the template position indicating element is located under the patient's skin at the position of the external unit position mark on the patient's skin;

marking, by using the implant position marking opening, a position of the receptacle, and removing the template from a body of the patient.

22. The method of claim 21, wherein said receptacle is created by using the implant position marking opening as a template for a cutting or drilling tool.

23. The method of claim 21, wherein the external unit has a circular, disc shape and wherein said external unit position mark indicates the desired final position of a center of the external unit.

* * * * *